US007238650B2

(12) United States Patent
Calder et al.

(10) Patent No.: US 7,238,650 B2
(45) Date of Patent: Jul. 3, 2007

(54) LOW-CHLORINE, POLYOLEFIN-SUBSTITUTED, WITH AMINE REACTED, ALPHA-BETA UNSATURATED CARBOXYLIC COMPOUNDS

(75) Inventors: Raymond M. Calder, Allstreet (GB); Steven A. Goodlive, Chardon, OH (US); Jeffry G. Dietz, Shaker Heights, OH (US); Wolfie Kotzen, Houston, TX (US); Brent R. Dohner, Concord, OH (US); Frederic Martin, Montivilliers (FR); John K. Pudelski, Cleveland Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 545 days.

(21) Appl. No.: 10/482,942

(22) PCT Filed: Jun. 27, 2002

(86) PCT No.: PCT/US02/20622

§ 371 (c)(1),
(2), (4) Date: Jan. 5, 2004

(87) PCT Pub. No.: WO03/004589

PCT Pub. Date: Jan. 16, 2003

(65) Prior Publication Data

US 2004/0147412 A1 Jul. 29, 2004

(51) Int. Cl.
*C10M 141/06* (2006.01)
*C10M 105/70* (2006.01)

(52) U.S. Cl. ..... 508/291; 508/506; 44/331

(58) Field of Classification Search ..... 508/291, 508/506; 44/331
See application file for complete search history.

(56) References Cited

U.S. PATENT DOCUMENTS 4,676,917 A * 6/1987 Sung et al. ..... 508/515
5,565,528 A * 10/1996 Harrison et al. ..... 525/327.6
5,821,205 A * 10/1998 Harrison et al. ..... 508/291
5,872,053 A * 2/1999 Smith ..... 438/626
5,880,070 A * 3/1999 Harrison et al. ..... 508/454
6,015,776 A * 1/2000 Harrison et al. ..... 508/192
6,045,766 A * 4/2000 Moser ..... 423/240 R
6,060,437 A * 5/2000 Robson et al. ..... 508/371
6,146,431 A * 11/2000 Harrison et al. ..... 44/331
6,156,850 A * 12/2000 Harrison et al. ..... 525/329.6
6,165,235 A * 12/2000 Kolp et al. ..... 44/331
6,207,624 B1 * 3/2001 Stachew et al. ..... 508/290

FOREIGN PATENT DOCUMENTS

EP 355895 A2 * 2/1990
WO WO 96 01854 1/1996
WO WO 99 16852 4/1999
WO WO 9916852 A1 * 4/1999

OTHER PUBLICATIONS

U.S. Appl. No. 10/407,983, filed Apr. 4, 2003.
European Application 648 830 A, Apr. 19, 1995.
European Application 959 042 A, Aug. 19, 1998.
European Application 355 895 A, Feb. 28, 1990.

* cited by examiner

*Primary Examiner*—Vasu Jagannathan
*Assistant Examiner*—James Goloboy
(74) *Attorney, Agent, or Firm*—David M. Shold; Michael F. Esposito

(57) ABSTRACT

A composition of matter comprising an amine acylated with a hydrocarbyl group substituted carboxylic acylating agent containing an average of from 1.3 to 1.6 groups derived from α,β-unsaturated carboxylic compounds per $\overline{M}_n$ of the hydrocarbyl group, wherein the hydrocarbyl group has $\overline{M}_n$ determined by GPC ranging from 1500 to 3000, the amine comprises polyamine bottoms and said acylated amine has total base number (TBN) ranging from 17 to 35. A method for preparing the composition, lubricating oils containing the composition and, in another embodiment, lubricating oil compositions of this invention further comprising a metal overbased sulfonate detergent.

20 Claims, No Drawings

LOW-CHLORINE, POLYOLEFIN-SUBSTITUTED, WITH AMINE REACTED, ALPHA-BETA UNSATURATED CARBOXYLIC COMPOUNDS

FIELD OF THE INVENTION

The present invention relates to high performance dispersants for lubricating oil compositions, particularly ashless dispersants, more particularly succinimide dispersants, for engine lubricating oils.

BACKGROUND OF THE INVENTION

The ILSAC (International Lubricant Standardization and Approval Committee) GF-3 Minimum Performance Standard for Passenger Car Engine Oils, published Oct. 12, 2000 is a cooperative standard from major automobile manufacturers throughout the world and the Engine Manufacturers Association, Inc. This standard specifies the minimum performance requirements (both engine sequence and bench tests) and chemical and physical properties for those engine oils that manufacturers deem necessary for satisfactory equipment performance and life.

Problems with the current situation for the synthesis of lubricant additives outlined above is that they have a high halogen content which is causing increased environmental concerns for the continued use of the lubricants and fuels containing them. Low chlorine or chlorine free lubricants are becoming more and more desirable.

A heretofore preferred manner of making lubricant additives has been to alkylate α-β unsaturated acids or anhydrides in the presence of chlorine then to convert the resulting acylating agent to a derivative such as an ester, amide, imide, or metal salt. This type of reaction yields halogen containing polyalkenyl or hydrocarbyl-substituted acids or anhydrides which may be called alkyl substituted carboxylic acylating agents. The substituted carboxylic acylating agents containing halogen can then be further reacted with amines, polyamines, alcohols, amino-alcohols or metal salts to form halogen containing dispersants, esters and metal salts. It is not uncommon for the polyalkenyl-substituted carboxylic acylating agents to have chlorine contents of 0.5-1%. This corresponds to 5,000-10,000 parts per million chlorine.

Examples of U.S. patents which describe methods for preparing hydrocarbyl-substituted aliphatic carboxylic acylating agents, and particularly polyalkenyl-substituted carboxylic acylating agents utilizing various amounts of chlorine include U.S. Pat. No. 3,215,707 (Rense); U.S. Pat. No. 3,231,587 (Rense); U.S. Pat. No. 3,454,607 (LeSuer); U.S. Pat. Nos. 3,912,764; 4,110,349; 4,234,435 (Meinhardt); and U.S. Pat. No. 5,041,622 (LeSuer). U.S. Pat. No. 4,234,435 describes carboxylic derivative compositions produced by reacting at least one substituted succinic acylating agent with a reactant such as amines, alcohols, reactive metals or combinations thereof. The substituted succinic acylating agent consists of polyalkenyl substituent groups and succinic groups. The substituent groups are derived from a polyalkene having an $\overline{M}_n$ value of about 1300 to about 5000 and an $\overline{M}_w/\overline{M}_n$ value of about 1.5 to about 4. The acylating agents are characterized by the presence within their structure of an average of more than one succinic group for each equivalent weight of substituent groups. Because of the presence of the excess of succinic groups in the acylating agents, such compounds have been referred to in the art as "over succinated," and the products described in the '435 patent have also been characterized as detergents and viscosity improving additives in lubricating oil compositions. When such derivatives are incorporated into lubricating compositions, they impart sufficient fluidity modifying properties to the lubricant which are sufficient to permit elimination of all or a significant amount of viscosity index improver from multi-grade lubricant compositions.

The acylating agents utilized in preparing the lubricant additives described in U.S. Pat. No. 4,234,435 are prepared by reaction of polyisobutene polymer with an α-β unsaturated dicarboxylic acid or anhydride such as maleic anhydride in the presence of chlorine. In such instances, the products which are obtained from the reaction and the products obtained from subsequent reaction with amines, alcohols, alcohols and metal compounds contain various amounts of halogen. Due to environmental concerns, it has now become desirable to eliminate or reduce the level of chlorine. One potential solution to eliminating the chlorine contained in such lubricant and fuel additives is simply to not use chlorine in the manufacturing process. Another potential solution is to develop procedures for treating such compositions to remove the chlorine which is present.

One procedure for treating various chlorine-containing organic compounds to reduce the level of chlorine therein has been described in a European patent application published under Publication No. 684 262. The procedure comprises heating, particularly under a nitrogen purge, chlorine containing succinic compounds. U.S. Pat. No. 4,282,157 discusses a method for preparing lower chlorine containing polyalkenyl substituted succinic anhydrides and U.S. Pat. No. 4,330,471 relates to alkylene polyamine derivatives of these succinic anhydrides.

Published European patent application No. 655,242 describes a procedure for reducing the chlorine content of organochlorine compounds comprising introducing a source of iodine or bromine into the organochlorine compound and contacting the components of the resulting mixture for a sufficient amount of time to reduce the chlorine content without substantially incorporating iodine or bromine into the organochlorine compound. This procedure is successful in reducing the chlorine content of organochlorine compounds, but in some instances, it is desirable to even further reduce the amount of chlorine in additive compositions which are to be utilized in lubricants and fuels.

Another published method of reducing the chlorine content of organo-chlorine compounds is described in U.S. Pat. No. 5,489,390. The method comprises treating the chlorine-containing compound with an acid.

As mentioned above, one technique for reducing the amount of chlorine in additive compositions based on polyalkenyl-substituted dicarboxylic acids is to prepare such hydrocarbon-substituted dicarboxylic acids in the absence of chlorine, and procedures have been described for preparing such compounds by the "thermal" process in which the polyolefin and the unsaturated dicarboxylic acid are heated together, optionally in the presence of a catalyst.

U.S. Pat. No. 6,077,909 relates to a method for producing polyolefin substituted carboxylic acylating agents having less than 1000 ppm chlorine and reaction products, such as dispersants, formed therefrom.

U.S. Pat. No. 6,165,235 describes polyolefin substituted carboxylic acylating agents having chlorine content <2000 ppm and having a degree of succination ranging from 1.1-2, said acylating agents being further reacted with amines and/or alcohols to form dispersants having reduced chlorine content.

U.S. Pat. Nos. 4,904,401; 4,938,881; 4,952,328; 4,957,649 and 4,981,602 relate to lubricating oil compositions, particularly to lubricating oil compositions meeting certain industry specifications.

It has now been found that nitrogen-containing carboxylic dispersants having hydrocarbyl substituent groups having a specified minimum number average molecular weight ($\overline{M}_n$), derived from hydrocarbyl substituted acylating agents having a specified minimum degree of succination, having a specified total base number and derived from certain amine reactants, provide lubricants meeting GF-3 and top-tier European lubricant requirements, offer good economics and allow for formulation of low chlorine containing products.

Requirements for top tier lubricants include improved seals performance as measured by the VW Seals test (PV3344), a fluoroelastomer stability test, piston deposits and ring sticking better than a standard, baseline lubricant using the Volkswagen 1.6L Diesel Intercooler test (Volkswagen VW TDI test), and improved extended drain capability as measured by the Volkswagen T4 test (Test method PV 1449)

SUMMARY OF THE INVENTION

The present invention relates to a composition of matter comprising an amine acylated with a hydrocarbyl group substituted carboxylic acylating agent containing an average of 1.3 to 1.6 groups derived from α,β-unsaturated carboxylic compounds per $\overline{M}_n$ of the hydrocarbyl group, that is, per equivalent of the hydrocarbyl group, defined as $\overline{M}_n$, determined by GPC, which is 1500 to 3000, the amine comprises polyamine bottoms and said acylated amine has total base number (TBN) of 17 to 35 on a neat chemical basis.

The invention further provides a method for preparing the above composition, lubricating oils containing the composition and, in another embodiment, lubricating oil compositions of this invention further comprising a metal overbased sulfonate detergent.

DETAILED DESCRIPTION OF THE INVENTION

As used herein, the term "hydrocarbon" means a group which is purely hydrocarbon, that is, a compound of hydrogen and carbon containing no hetero atoms. The terms "hydrocarbyl" and "hydrocarbon based" means that the group being described has predominantly hydrocarbon character within the context of this invention. Hydrocarbyl and hydrocarbon based groups include groups that are purely hydrocarbon in nature, that is, they contain only carbon and hydrogen. They may also include groups containing non-hydrocarbon substituents or atoms which do not alter the predominantly hydrocarbon character of the group. Such substituents may include halo-, alkoxy-, or nitro-. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms. Thus, the terms "hydrocarbyl" and "hydrocarbon based" are broader than the term "hydrocarbon" since all hydrocarbon groups are also hydrocarbyl or "hydrocarbon based" groups while hydrocarbyl groups or hydrocarbon based groups containing hetero atoms are not hydrocarbon groups as defined herein.

In general, no more than three non-hydrocarbon substituents or hetero atoms, and preferably no more than one, will be present for every 10 carbon atoms in hydrocarbyl or hydrocarbon based groups. Most preferably, these groups are purely hydrocarbon in nature, that is they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

It must be noted that as used in this specification and appended claims, the singular forms also include the plural unless the context clearly dictates otherwise. Thus the singular forms "a", "an", and "the" include the plural; for example "an olefin" includes mixtures of olefins of the same type. As another example the singular form "olefin" is intended to include both singular and plural unless the context clearly indicates otherwise.

Hydrocarbyl Substituted Carboxylic Acylating Agent

The compositions of this invention are amines acylated with hydrocarbyl group substituted carboxylic acylating agent containing an average of 1.4 to 1.6 groups derived from α,β-unsaturated carboxylic compounds per equivalent of the hydrocarbyl group, that is, per $\overline{M}_n$ of the hydrocarbyl group, wherein the hydrocarbyl group has $\overline{M}_n$ determined by GPC of 1500 or 1700 to 3000 and the amine comprises polyamine bottoms and said acylated amine has total base number of 20 to 35 on a neat chemical basis.

Preferably, the hydrocarbyl group substituent is an aliphatic polyolefin group, wherein the polyolefin is derived from aliphatic olefins containing 2 to 30 carbon atoms, preferably 3 to 8 carbon atoms, more preferably, propylene and butene and especially isobutylene. Preferred polyolefin groups are polypropylene and polybutenes. Polyisobutylene is particularly preferred. Preferred polyolefins comprise polyisobutylene wherein at least 5% of the terminal groups are vinylidene groups, preferably at least 30% terminal vinylidene groups.

The hydrocarbyl-substituted carboxylic acylating agents of the present invention include carboxylic acids and their reactive equivalents such as acid halides, anhydrides, and esters, including partial esters. These may be mono or polycarboxylic acid materials or reactive equivalents thereof. Examples of carboxylic groups are propionic and succinic groups. Preferably, the hydrocarbyl substituted carboxylic acylating agents are polycarboxylic acylating agents and especially, succinic acylating agents.

In one preferred embodiment, the hydrocarbyl substituted carboxylic acylating agent comprises at least one hydrocarbyl-substituted succinic acylating agent consisting of at least one hydrocarbyl substituent and at least one succinic group wherein the hydrocarbyl substituent is derived from a polyolefin, preferably, polyisobutylene.

The hydrocarbyl-substituted succinic acid or succinic anhydride can be represented correspondingly by the formulas

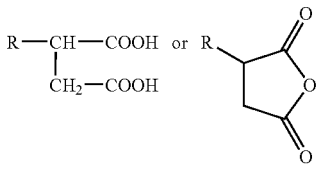

wherein R is a hydrocarbyl group.

The hydrocarbyl substituted carboxylic acylating agents are prepared by the reaction of one or more of the above-described polyolefins with one or more unsaturated carboxylic reagents. The unsaturated carboxylic reagents include unsaturated carboxylic acids per se and functional derivatives thereof, such as anhydrides, esters, salts and acyl halides,. The unsaturated carboxylic reagents include mono-, di-, tri, or tetracarboxylic acids. Examples of useful unsaturated monobasic acids include acrylic acid, methacrylic acid, cinnamic acid, crotonic acid, and 2-phenylpropenoic acid. Polybasic unsaturated carboxylic acids include maleic acid, fumaric acid, mesaconic acid, itaconic acid, and citraconic acid; their anhydrides are preferred and maleic anhydride is particularly preferred. Reactive equivalents of such anhydrides include the above-mentioned derivative, e.g., acids, esters, half esters, salts, and acyl halides, which can also serve as carboxylic reagents.

The acylating agents can be prepared by reacting one or more of the polyolefins with, typically, a stoichiometric excess of a carboxylic reagent such as maleic anhydride. Such reaction provides a substituted carboxylic acylating agent having at least one carboxylic group, preferably succinic groups, For each equivalent weight of the hydrocarbyl group, there may be more than one carboxylic group.

For purposes of this calculation, the number of equivalent weight of substituent groups is deemed to be the number corresponding to the quotient obtained by dividing the $\overline{M}_n$ (number average molecular weight) value of the polyalkene from which the substituent is derived into the total weight of the substituent groups present in the substituted acylating agent. Thus, if a substituted succinic acylating agent is characterized by a total weight of substituent group of 40,000 and the $\overline{M}_n$ value for the polyalkene from which the substituent groups are derived is 2000, then that substituted succinic acylating agent is characterized by a total of 20 (40,000/2000=20) equivalent weights of substituent groups.

Methods for preparing succinic acylating agents satisfying these parameters are described in U.S. Pat. No. 4,234,435. In particular, this patent discloses (in column 19) a process for preparing such materials by heating at a temperature of about 160° C. to about 220° C. a mixture comprising: Polybutene characterized by a $\overline{M}_n$ value of about 1700 to about 2400, in which at least 50% of the total units derived from butenes is derived from isobutene; one or more acidic reactants of the formula

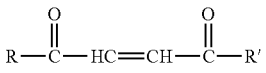

wherein R and R' are each —OH or when taken together, R and R' are —O—; and chlorine.

Specific examples of preparation of such acylating agents are set forth in Examples 1 through 9 of U.S. Pat. No. 4,234,435. Similar examples can be found in U.S. Pat. Nos. 3,215,707, 3,219,666, and 3,231,587.

The hydrocarbon group substituted acylating agent may be prepared by a process comprising forming a mixture of a polyolefin having a total of tetra- and tri-substituted unsaturated end groups up to 90 mole % based on moles of polyolefin and a halogen selected from the group consisting of chlorine and bromine, wherein said halogen is present in said mixture on a molar basis up to an amount equal to the moles of tetra- and tri-substituted end groups and adding to said mixture of 1.5 to 2.5 moles, per equivalent of polyolefin, of an α,β-unsaturated carboxylic compound, sequentially or simultaneously with addition of said halogen, reacting said mixture at 170° C. to 220° C. to effect reaction of the polyolefin and α,β-unsaturated carboxylic compound, reducing the temperature to less than 200° C. and adding thereto additional halogen and α,β-unsaturated carboxylic compound in about equal molar amounts then reacting the mixture to reduce unreacted α,β-unsaturated carboxylic compound to less than 3%.

In another embodiment, the hydrocarbon group substituted acylating agent may be prepared by a process comprising forming a mixture of a polyolefin having a total of tetra- and tri-substituted unsaturated end groups up to 90 mole % based on moles of polyolefin and a halogen selected from the group consisting of chlorine and bromine, wherein said halogen is present in said mixture on a molar basis up to an amount equal to the moles of tetra- and tri-substituted end groups and adding to said mixture 1.5 to 2.5 moles per equivalent of polyolefin of an α,β-unsaturated carboxylic compound, sequentially or simultaneously with addition of said halogen, reacting said mixture at 170° C. to 220° C. to effect reaction of the polyolefin and α,β-unsaturated carboxylic compound, reducing the temperature to less than 200° C. and adding thereto additional halogen on a molar basis up to an amount equal to the moles of tetra- and tri-substituted end groups, then reacting the mixture to reduce unreacted. α,β-unsaturated carboxylic compound to less than 3%.

Other processes can be used, if desired, which do not employ chlorine, and this is preferred if the presence of chlorine is undesirable for environmental reasons. Bromine can be used in place of chlorine; or the reactants can be heated together at 150 to 200 or 230° C. in the absence of halogen. Moreover, it is generally unnecessary to use chlorine when using high vinylidene polyolefin reactants. The hydrocarbyl group substituted acylating agent may be prepared by direct thermal alkylation of an α,β-unsaturated carboxylic compound with a polyolefin. Preparation using the so-called "thermal" route is generally described in European Patent 355,895.

In the formation of the hydrocarbyl-substituted acylating agent, the conditions for the reaction of the polyolefin with the carboxylic reagent such as maleic anhydride, and the relative concentrations of such components, should preferably be sufficient that a majority of the olefin polymer has reacted with at least one molecule of the acylating reagent. That is, it is preferred, for optimum performance that no more than 30 percent by weight of the polymer should remain unreacted in the resulting acylating agent, preferably no more than 25 percent, and more preferably no more than 20 percent, should remain unreacted. For the purposes of this invention, unreacted polyolefin is often considered to constitute part of the diluent.

While reaction of the polyolefin with the carboxylic reagent is preferably conducted in the absence of chlorine, it is possible to prepare hydrocarbyl substituted acylating agents by a process involving chlorine. However, it is especially preferred that the preparation of the hydrocarbyl substituted acylating agent be conducted in the absence of chlorine.

The resulting hydrocarbyl substituted carboxylic acylating agent contains an average of 1.3 to 1.6 groups derived from α,β-unsaturated carboxylic compounds per $\overline{M}_n$ of the hydrocarbyl group; in various embodiments, 1.3 to 1.4, or 1.4 to 1.6. When the α,β-unsaturated carboxylic compound is a dicarboxy compound, such as maleic acid or maleic anhydride, each such group will comprise two individual carboxy moieties; thus there can be 2.6 to 3.2 individual carboxy moieties per $\overline{M}_n$ of the hydrocarbyl group.

Amine Reactant

The amine reactants useful in this invention are those described in the art as "polyamine bottoms." Polyamine bottoms are polyamine mixtures obtained as the residue from stripping complex mixtures of alkylene, usually ethylene, polyamines which complex mixtures include cyclic condensation products such as piperazines. These complex alkylene polyamine mixtures are typically those produced by the reaction of alkylene chloride, usually alkylene dichlorides, with ammonia or reaction of an ethylene imine with a ring opening reagent such as water or ammonia.

In general, alkylene polyamine bottoms can be characterized as having less than 2%, usually less than 1% by weight material boiling below 200° C.

Typical of such ethylene polyamine bottoms is that designated as "E-100," obtained from Dow Chemical Co., Freeport Tex., USA. This material has nominal specifications of specific gravity at 15.6° C. of 1.0168; % N=33.15, kinematic viscosity at 40° C.=121 $mm^2/s$ (centistokes, cSt). Gas chromatography shows it contains about 0.93% light ends (most probably diethylene triamine), 0.72% triethylenetetramine, tetraethylenepentamine and 76.61% pentaethylene hexamine and higher (all by weight). Another example of polyethylene bottoms is a product sold by Union Carbide Chemicals as HPA-X, having equivalent weight (per N)=40.5.

The polyamines contain at least one >N—H group per molecule. These polyamines bottoms can be reacted solely with the acylating agent or they can be used with other amines, polyamines or mixtures thereof, provided that the major amount, on an equivalent N—H basis, is alkylene polyamine bottoms.

The acylated amine comprises at least one member of the group consisting of amide, imide and salt. Often the acylated amine is a mixture of two or more of these.

The acylated amine of this invention typically possesses a base number arising from the presence of the amine. Often the total base number on a neat chemical basis (that is, correcting for the presence of any diluent oil) is 17 or 20 to 35, more often 20 or 24 to 30. In one embodiment it can be 17 to 20. When the acylated amine is prepared from a low chlorine containing acylating agent the chlorine content of the acylated amine also is correspondingly low. Typically, the chlorine content, on a neat chemical basis, is up to 0.6% e.g., 0.01% to 0.6% or to 0.4% or to 0.2%.

Reactions to prepare the hydrocarbyl substituted acylating agent are usually conducted in the substantial absence of diluent, although a substantially inert, normally liquid diluent such as mineral oil or hydrocarbon solvent may be used. The reaction of the hydrocarbyl substituted acylating agent with the amine may also be conducted neat or in the presence of a substantially inert, normally liquid diluent. Typically, if a diluent is used, it comprises mineral oil which remains in the product. If volatile diluents are used, it is usually necessary to remove the diluent by techniques such as distillation such that the resulting product has an acceptable flash point, i.e., is not unacceptably flammable. When a diluent is present in the acylated amine, it is usually present in an amount of 30 to 70 parts per 100 parts of acylated amine. As noted hereinabove, polyolefin remaining unreacted from the reaction forming the hydrocarbon group substituted acylating agent is deemed to be part of the diluent.

The following examples illustrate hydrocarbyl substituted carboxylic acylating agents and acylated amines of this invention. All temperatures are in degrees Celsius, parts and percentages are by weight and filtrations are conducted with a diatomaceous earth filter aid.

EXAMPLE 1

A reactor is charged with 1000 parts of polyisobutylene having $\overline{M}_n$ approximately 2000 and 76 parts maleic anhydride. The materials are heated to 138° C. whereupon 30.2 parts chlorine are added over 5 hours while the temperature is increased to 165° C. The batch is then heated to 182° C. and held for 1 hour. A second chlorination is begun and a total of 30.2 parts chlorine are added over 5 hours while the temperature is increased to 196° C. The batch is then held for a minimum of 2 hours until the batch contains unreacted maleic anhydride less than 0.90%. The residue contains 0.38% Cl.

EXAMPLE 2

The process of Example 1 is continued, heating at 232° C. and holding at temperature for 4 hours followed by 4 more hours at 216° C. % Cl=0.12.

EXAMPLE 3

A reactor is charged with 1000 parts of the product of Example 1 and 780.0 parts mineral oil. After the temperature is adjusted to 110° C., 46.24 parts of polyethyleneamine bottoms are added over 2 hours while allowing the batch to exotherm to 127° C. The temperature is then increased to 152° C. and the batch is $N_2$ blown for 1 hour then filtered. The product contains 45% mineral oil, 0.77% N and has total base number=15.

EXAMPLE 4

The procedure of Example 3 is repeated replacing the product of Example 1 with an equal weight of the product of Example 2. The product contains 45% mineral oil, Total base no.=15, total acid no=5.

Other Additives

The compositions of this invention may contain minor amounts of other components. The use of such additives is optional and the presence thereof in the compositions of this invention will depend on the particular use and level of performance required. The compositions may comprise metal salts, preferably a zinc salt, of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and anti-oxidancy performance.

In addition to metal salts of dithiophosphoric acids discussed hereinabove, other additives that may optionally be used in the lubricating oils of this invention include, for example, detergents, auxiliary dispersants, viscosity improvers, oxidation inhibiting agents, metal passivating agents, pour point depressing agents, extreme pressure agents, anti-wear agents, color stabilizers and anti-foam agents.

Phenolic compounds and aromatic amines are useful oxidation inhibitors. Preferred are hindered phenolic compounds, for example, 2,6-ditertiary butyl phenol and secondary aromatic amine compounds, for example N,N-di (alkylphenyl)amines.

Extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites and molybdenum compounds.

Viscosity improvers (also sometimes referred to as viscosity index improvers) may be included in the compositions of this invention. Viscosity improvers are usually polymers, including polyisobutenes, polymethacrylic acid esters, diene polymers, polyalkylstyrenes, alkenylarene-conjugated diene copolymers and polyolefins. Multifunctional viscosity improvers, which have dispersant and/or antioxidancy properties are known and may optionally be used. Such products are described in numerous publications.

Pour point depressants are a particularly useful type of additive often included in the lubricating oils described herein. See for example, page 8 of "Lubricant Additives" by C. V. Smalheer and R. Kennedy Smith (Lezius-Hiles Company Publisher, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures. Examples of pour point depressants are polyacrylates, alkylated naphthalenes, styrene/alkyl maleate and fumarate—and maleate ester/vinyl acetate copolymers.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

Detergents and auxiliary dispersants may be of the ash-producing or ashless type. The ash-producing detergents are exemplified by oil soluble neutral and basic salts, wherein "basic salt" is used to designate metal salts wherein the metal is present in stoichiometrically larger amounts than the organic acid radical, of alkali or alkaline earth metals with sulfonic acids, carboxylic acids, phenols or organic phosphorus acids characterized by at least one direct carbon-to-phosphorus linkage.

Basic salts and techniques for preparing and using them are well known to those skilled in the art and need not be discussed in detail here. The extent of overbasing resulting in a basic salt is indicated by the term metal ratio (MR) which indicates the number of equivalents of base per equivalent of acid.

Auxiliary ashless detergents and dispersants may be used. These are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least 34 and preferably at least 54 carbon atoms with nitrogen containing compounds such as amine, organic hydroxy compounds such as phenols and alcohols, and/or basic inorganic materials. Examples of these "carboxylic dispersants" are described in British Patent number 1,306,529 and in many U.S. patents including the following:

| |
|---|
| 3,163,603 |
| 3,184,474 |
| 3,215,707 |
| 3,219,666 |
| 3,271,310 |
| 3,272,746 |
| 3,281,357 |
| 3,306,908 |
| 3,311,558 |
| 3,316,177 |
| 3,340,281 |
| 3,341,542 |
| 3,346,493 |
| 3,351,552 |
| 3,381,022 |
| 3,399,141 |
| 3,415,750 |
| 3,433,744 |
| 3,444,170 |
| 3,448,048 |
| 3,448,049 |
| 3,451,933 |
| 3,454,607 |
| 3,467,668 |
| 3,501,405 |
| 3,522,179 |
| 3,541,012 |
| 3,541,678 |
| 3,542,680 |
| 3,567,637 |
| 3,574,101 |
| 3,576,743 |
| 3,630,904 |
| 3,632,510 |
| 3,632,511 |
| 3,697,428 |
| 3,725,441 |
| 4,194,886 |
| 4,234,435 |
| 4,491,527 |
| 5,696,060 |
| RE 26,433 |

(2) Reaction products of relatively high molecular weight aliphatic or alicyclic halides with amines, preferably polyalkylene polyamines. These may be characterized as "amine dispersants" and examples thereof are described, for example, in the following U.S. patents:

| |
|---|
| 3,275,554 |
| 3,438,757 |
| 3,454,555 |
| 3,565,804 |

(3) Reaction products of alkyl phenols in which the alkyl groups contains at least 30 carbon atoms with aldehydes (especially formaldehyde) and amines (especially polyalkylene polyamines), which may be characterized as "Mannich dispersants". The materials described in the following U.S. patents are illustrative:

| |
|---|
| 3,413,347 |
| 3,697,574 |
| 3,725,277 |
| 3,725,480 |
| 3,726,882 |

(4) Products obtained by post-treating the carboxylic amine or Mannich dispersants with such reagents are urea, thiourea, carbon disulfide, aldehydes, ketones, carboxylic acids, hydrocarbon-substituted succinic anhydrides, nitrites, epoxides, boron compounds, phosphorus compounds or the like. Exemplary materials of this kind are described in the following U.S. patents:

| |
|---|
| 3,036,003 |
| 3,087,936 |
| 3,200,107 |
| 3,216,936 |
| 3,254,025 |
| 3,256,185 |
| 3,278,550 |
| 3,280,234 |
| 3,281,428 |
| 3,282,955 |
| 3,312,619 |
| 3,366,569 |
| 3,367,943 |
| 3,373,111 |
| 3,403,102 |
| 3,442,808 |
| 3,455,831 |
| 3,455,832 |
| 3,493,520 |
| 3,502,677 |
| 3,513,093 |
| 3,533,945 |
| 3,539,633 |
| 3,573,010 |
| 3,579,450 |
| 3,591,598 |
| 3,600,372 |
| 3,639,242 |
| 3,649,229 |
| 3,649,659 |
| 3,658,836 |
| 3,697,574 |
| 3,702,757 |
| 3,703,536 |
| 3,704,308 |
| 3,708,522 |
| 4,234,435 |

(5) Interpolymers of oil-solubilizing monomers such as decyl methacrylate, vinyl decyl ether and high molecular weight olefins with. monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents:

| |
|---|
| 3,329,658 |
| 3,449,250 |
| 3,519,565 |
| 3,666,730 |
| 3,687,849 |

-continued

| |
|---|
| 3,702,300 |

The above-noted patents are incorporated by reference herein for their disclosures of ashless dispersants.

The above-illustrated additives may each be present in lubricating compositions at a concentration of as little as 0.001% by weight usually 0.01% to 20% by weight, more often 1% to 12% by weight.

Lubricating Oil Compositions

The lubricating compositions and methods of this invention employ an oil of lubricating viscosity, including natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types.

Hydrorefined, including hydrotreated, hydrocracked and hydroisomerized oils are included within the scope of useful oils of lubricating viscosity. These oils are usually substantially saturated being at least 90% saturated and often contain no readily discernable unsaturation. These are commercially available from a number of suppliers. Examples include hydroisomerized oils supplied by Neste OY, Finland under the tradename NEXBASE®. Hydrotreated naphthenic oils are also well known.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, and analogs and homologues thereof.

Polymerized and interpolymerized olefins constitute an especially preferred group of synthetic oils. Examples are polyoctenes and polydecenes. These typically have viscosities at 100° C. of 4 to 10 $mm^2/s$ (centistokes), more often 40 to 8, often to 6 $mm^2/s$. In one embodiment, the oil of lubricating viscosity comprises at least 20%, and preferably at least 25 percent or 30% or greater by weight of a polyolefin basestock.

Alkylene oxide polymers and interpolymers and derivatives thereof, and those where terminal hydroxyl groups have been modified by methods such as esterification or etherification, constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyol ethers.

Other synthetic lubricating oils include liquid esters of phosphorus-containing acids, polymeric tetrahydrofurans, and silicon-based oils such as the polyalkyl-, polyaryl-, polyalkoxy-, or polyaryloxy-siloxane oils and silicate oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

In one embodiment, preferred oils of lubricating viscosity comprise API Group III oils. These contain ≦0.03% sulfur, ≧90% saturates and viscosity index ≧120. Usually, the basestock comprises less than 50% by weight of Group III basestocks.

Oils of lubricating viscosity used in this invention may contain mixtures of two or more of the foregoing oils. In a preferred embodiment, mixtures of hydrorefined basestocks and synthetic basestocks, particularly polyolefins and more particularly polyolefins having a viscosity at 100° C. of 4 to 8 $mm^2/s$ (centistokes). Particularly preferred are mixtures of Group III oils and polyolefins described hereinabove. In one preferred embodiment, the Group III oil is a hydroisomerized basestock. In another preferred embodiment, the mixture comprises more than 30% by weight of a polyolefin oil.

Specific examples of the above-described oils of lubricating viscosity are given in Chamberlin III, U.S. Pat. No. 4,326,972 and European Patent Publication 107,282, both of which are hereby incorporated by reference for relevant disclosures contained therein.

Sequeria, Jr., in *Lubricant Base Oil and Wax Processing*, Marcel Deker, Inc., New York, N.Y., USA (1994) discusses lubricant oils and processes for preparing them. Hydrogen refining proce3sses are specifically described at pages 119-152 thereof.

A basic, brief description of lubricant base oils appears in an article by D. V. Brock, "Lubrication Engineering", Volume 43, pages 184-5, March, 1987, which article is expressly incorporated by reference for relevant disclosures contained therein.

Lubricating oil compositions of this invention comprise a major amount of an oil of lubricating viscosity and a minor amount of the acylated amine of this invention.

In one preferred embodiment, the lubricating oil composition further comprises a metal overbased detergent, preferably a sulfonate detergent, more preferably, a calcium overbased alkyl benzene sulfonic acid.

The lubricating oil composition typically comprises at least 1.2 or 2.5% by weight of the acylated amine and from about 0.25 or 0.5% to about 5% by weight of the metal overbased detergent (each on an active chemical basis) and has total base number of 3 to 15 wherein the acylated amine contributes at least 10% of the total base number.

Additive Concentrates

The composition of this invention may be present as a component of an additive concentrate. Additive concentrates comprise the compositions of this invention, optionally together with other performance improving additives in concentrated form, usually in the presence of a substantially inert, normally liquid, organic diluent. A wide variety of diluents such as hydrocarbon solvents and oils are useful diluents. More often, the diluent is an oil of lubricating viscosity.

A typical additive concentrate comprises 20% to 80% by weight of an acylated amine of this invention and 80% to 20% by weight of a normally liquid organic diluent. Other components may also be present in additive concentrates such as the other additives described hereinabove.

The following Examples illustrate lubricating oil compositions of this invention. All parts and percentages are by weight and unless specified otherwise, are on an oil or diluent-free basis.

EXAMPLE A

An additive concentrate is prepared by combining and mixing at an elevated temperature, 49.28 parts of the acylated amine of Example 4, 8.62 parts of a zinc salt of a mixed isopropyl-methyl amyl dithiophosphate, 6.76 parts dialkyl diphenylamine, 1.93 parts sulfurized butadiene-butyl acrylate adduct, 1.93 parts isooctyl-3,5-di-t-butyl-4-hydroxy hydrocinnamate (Ciba-Geigy, IRGANOX® L-135), 1.93 parts glycerol monooleate, 4.51 parts calcium overbased (MR 11) alkyl benzene sulfonic acid, 5.58 parts calcium overbased (MR 20) alkyl benzene sulfonic acid, 0.09 parts of a siloxane based antifoam agent and sufficient mineral oil to prepare 100 parts of additive concentrate. A lubricating oil composition is prepared by mixing, at an elevated temperature, 10.35 parts of the additive concentrate and sufficient oil of lubricating viscosity (Texaco) to prepare 100 parts of lubricant.

EXAMPLE B

An additive concentrate is prepared by combining and mixing at an elevated temperature, 58.94 parts of an acylated amine prepared as in Example 4, 5.90 parts of a zinc salt of a mixed isopropyl-methyl amyl dithiophosphate, 3.31 parts dialkyl diphenylamine, 3.31 parts of a t-butylated phenol, 0.1 part of oleylamide, 6.06 parts calcium overbased (MR 3.5) sulfurized alkyl phenol, 5.38 parts calcium overbased (MR11) alkyl benzene sulfonic acid, 3.31 parts calcium overbased (MR 1.2) alkyl benzene sulfonic acid, 0.1 parts of a siloxane based antifoam agent and sufficient mineral oil to prepare 100 parts of additive concentrate. A lubricating oil composition is prepared by mixing, at an elevated temperature, 15.1 parts of the additive concentrate and sufficient oil of lubricating viscosity (31.8% 4 $mm^2/s$ (cSt) polyalphaolefin (Chevron) and 68.2% hydroisomerized base oil (5 $mm^2/s$ (cSt)/135 N, NEXBASE® 3050)) to prepare 100 parts of lubricant.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Each of the documents referred to above is incorporated herein by reference. Except in the examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. A composition of matter comprising an amine acylated with a hydrocarbyl group substituted carboxylic acylating agent containing an average of about 1.3 to about 1.6 groups derived from α,β-unsaturated carboxylic compounds per equivalent of the hydrocarbyl group, wherein the equivalent weight of the hydrocarbyl is defined as its $\overline{M}_n$, determined by GPC, which is about 1500 to about 3000, the amine comprises polyamine bottoms, and said acylated amine has total base number (TBN) of about 17 to about 35 on a neat chemical basis, wherein said hydrocarbyl group substituted carboxylic acylating agent (i) is prepared by direct thermal alkylation of an α,β-unsaturated carboxylic compound with a polyolefin, or (ii) is prepared by a process comprising forming a mixture of a polyolefin having a total of tetra- and tri- substituted unsaturated end groups up to 90 mole % based on moles of polyolefin and a halogen selected from the group consisting of chlorine and bromine, with an α,β-unsaturated carboxylic compound.

2. The composition of claim 1 wherein the hydrocarbyl group substituent comprises a polyisobutylene group.

3. The composition of claim 1 wherein the carboxylic groups comprise at least one member of the group consisting of succinic acid, propionic acid, and reactive equivalents thereof.

4. The composition of claim 1 wherein the hydrocarbyl group has a $\overline{M}_n$ of about 1700 to about 3000.

5. The composition of claim 1 having on a neat chemical basis, total base number of about 20 to about 30.

6. The composition of claim 1 having on a neat chemical basis, chlorine content of up to about 0.6%.

7. The composition of claim 1 further comprising about 30 to about 70 parts of a diluent, per 100 parts by weight of the composition.

8. The composition of claim 7 wherein the diluent comprises a mineral oil.

9. The composition of claim 1 wherein the hydrocarbon group substituted acylating agent is prepared by a process comprising forming a mixture of a polyolefin having a total of tetra- and tri- substituted unsaturated end groups up to about 90 mole % based on moles of polyolefin and a halogen selected from the group consisting of chlorine and bromine, wherein said halogen is present in said mixture on a molar basis up to an amount equal to the moles of tetra- and tri-substituted end groups and adding to said mixture from about 1.5 to about 2.5 moles per equivalent of polyolefin of an α,β-unsaturated carboxylic compound, sequentially or simultaneously with addition of said halogen, reacting said mixture at from about 170° C. to about 220° C. to effect reaction of the polyolefin and α,β-unsaturated carboxylic compound, reducing the temperature to less than about 200° C. and adding thereto additional halogen on a molar basis up to an amount equal to the moles of tetra- and tri- substituted end groups, then reacting the mixture to reduce unreacted α,β-unsaturated carboxylic compound to less than about 3.

10. The composition of claim 9 wherein said polyolefin comprises polyiso-butylene.

11. An additive concentrate comprising about 20% to about 80% by weight of the acylated amine of claim 1 and about 80% to about 20% by weight of a normally liquid organic diluent.

12. A lubricating oil composition comprising a major amount of an oil of lubricating viscosity and a minor amount of the acylated amine of claim 1.

13. The lubricating oil composition of claim 12 further comprising a metal overbased sulfonate detergent.

14. The composition of claim 13 wherein the metal overbased detergent is a calcium overbased alkyl benzene sulfonic acid.

15. The lubricating oil composition of claim 13 comprising at least about 1.2% by weight of the acylated amine and from about 0.25% to about 5% by weight of the metal overbased detergent.

16. The lubricating oil composition of claim 13 having total base number of about 3 to about 15 wherein the acylated amine contributes at least about 10% of the total base number.

17. The lubricating oil composition of claim 12 wherein the oil of lubricating viscosity comprises more than 20% by weight of a polyolefin basestock.

18. The lubricating oil composition of claim 17 wherein the oil of lubricating viscosity comprises a mixture of (a) polyolefin basestocks having a viscosity at 100° C. of about 4 to about 8 mm2/s (centistokes) and (b) an API Group III basestock.

19. A composition of matter comprising an amine acylated with a hydrocarbyl group substituted carboxylic acylating agent containing an average of about 1.3 to about 1.6 groups derived from α,β-unsaturated carboxylic compounds per equivalent of the hydrocarbyl group, wherein the equivalent weight of the hydrocarbyl is defined as its $\overline{M}_n$, determined by GPC, which is about 1500 to about 3000, the amine comprises polyamine bottoms, and said acylated amine has total base number (TBN) of about 17 to about 35 on a neat chemical basis, wherein said hydrocarbyl group substituted carboxylic acylating agent is prepared by direct thermal alkylation of an α,β-unsaturated carboxylic compound with a polyolefin.

20. The composition of claim 19 wherein at least about 30% of the terminal groups are vinylidene groups.

* * * * *